United States Patent [19]

Jessup

[11] 4,107,881

[45] Aug. 22, 1978

[54] CENTERLESS GRINDING MACHINE

[75] Inventor: Wilbur F. Jessup, The Hague, Netherlands

[73] Assignee: Cincinnati Milacron Inc., Cincinnati, Ohio

[21] Appl. No.: 803,569

[22] Filed: Jun. 6, 1977

[51] Int. Cl.[2] ..... B24B 5/32

[52] U.S. Cl. ..... 51/103 R; 51/103 TF

[58] Field of Search ..... 51/103 R, 103 WH, 103 TF, 51/165.87

[56] References Cited

U.S. PATENT DOCUMENTS

| | | | |
|---|---|---|---|
| 1,669,728 | 5/1928 | Vanderbeek | 51/103 WH |
| 1,862,882 | 6/1932 | Caster | 51/103 WH |
| 3,408,773 | 11/1968 | Cole | 51/103 R |

FOREIGN PATENT DOCUMENTS

| | | | |
|---|---|---|---|
| 524,304 | 5/1931 | Fed. Rep. of Germany | 51/103 R |

OTHER PUBLICATIONS

Farago, Francis, Abrasive Methods Engineering, Ch. 2-3, pp. 118-119, 1976.

*Primary Examiner*—N. P. Godici

*Attorney, Agent, or Firm*—Thomas M. Farrell

[57] ABSTRACT

A centerless grinder is adapted to have a regulating wheel feed towards a grinding wheel about a pivot point to accomplish an infeed grind operation on a plurality of parts between the wheels. The parts are infeed ground at a plurality of stations from an inlet end of the wheels to an outlet end of the wheels, and the pivot point is proximate the outlet end, thereby achieving variable feed distances and variable feed rates along the face of the regulating wheel relative to the grinding wheel, from the inlet end to the outlet end. After an infeed grind operation, the plurality of parts are advanced to their next adjacent stations for a subsequent grind operation. By the arrangement disclosed, coarse-feed grinding is performed on one workpiece while fine feed grinding is performed on another piece and varying degrees of rates of grinding are performed on the intermediate pieces during the same time interval.

8 Claims, 4 Drawing Figures

CENTERLESS GRINDING MACHINE

BACKGROUND OF THE INVENTION

In the centerless grinding art, when it is not convenient to have a part axially advance across the face of a grinding wheel, as during a "throughfeed" grinding operation, it may be necessary to perform what is called an "infeed" grind operation, wherein the workpiece is axially stationary while being ground. A typical example of a part which lends itself to an infeed grinding operation is a ring which has a generally toroidal profile, that is, non-cylindrical. When grinding thin parts, it is often convenient to stack them and simultaneously grind a plurality of workpieces. When a cylindrical regulating wheel is employed, the wheel is radially fed toward the grinding wheel, causing all parts to be shaped at the same time, to the same diameter. A novel prior art centerless grinding machine has been employed for infeed grinding of profiled surface parts by tapering the regulating wheel so that as the regulating wheel is advanced toward the grinding wheel, the shaped parts will have progressively stepped diameters, from a rough, stack-entering workpiece; to a smaller diameter, finished stack-exiting workpiece. After each grinding operation, the workpieces and regulating wheel are retracted from the grinding wheel and the workpiece stack is advanced to the next subsequent grinding station. However, one difficulty is inherent in this method of progressively producing the stacked workpieces, in that since the regulating wheel is linearly fed towards the grinding wheel, the same amount of grinding stock is removed from each workpiece in the same time interval.

In grinding art, it is generally preferable to rough grind a relatively large amount of stock from a workpiece per unit time, shaping it to a predetermined diameter, then later finish grinding the workpiece by removing a relatively small amount of stock per unit time from the predetermined intermediate diameter to the finished size, since wheel pressures and resulting deflections of the workpiece will be lessened during the finish grinding operation and the workpiece will tend to have a truer size and shape and better surface finish.

Applicant has obviated the difficulties inherent in the prior art design by employing a curvilinear regulating wheel profile which conforms generally to a stack of progressively reduced work sizes ranging from a largest size at an inlet end between the wheels to a smallest size at an outlet end between the wheels, wherein feeding is accomplished by pivoting the regulating wheelhead about a pivot point near the outlet end of the wheel. In this pivoting manner, the feed movement or feed arc is proportional to the distance from the pivot point to the successive workpieces. Thus, a coarse feed movement at the inlet end and a fine feed movement at the outlet end is achieved, with respective proportions therebetween along the wheel face. The pivot point, work support and regulating wheel are compensatingly movable in a linear direction toward the grinding wheel to adjust the work stack to the grinding wheel face after the grinding wheel has been conditioned by a suitable dressing means.

It is therefore an object of the present invention to provide a relatively simple feed mechanism for a stack of workpieces, which accomplishes varying feed and rate increments at the respective workpieces from an inlet end to an outlet end between the wheels.

SUMMARY OF THE INVENTION

The invention is shown embodied in a centerless grinder having a base which carries a rotatable grinding wheel and regulating wheel is rotatably carried in a regulating wheel head on the base so as to form an inlet end and an outlet end between the wheels. A work support is located between the wheels and carries a plurality of workpieces, defining a plurality of work stations for a plurality of infeed grind operations. The regulating wheel conforms to the progressively reduced workpiece diameters and the regulating wheel is pivoted about a point proximate to the outlet end, so that as the regulating wheel is pivoted, varying feed movements occur along the face of the regulating wheel relative to the grinding wheel which are proportional to the distance from the pivot point to the respective work stations.

DESCRIPTION OF THE PREFERRED EMBODIMENT

Figure 1:
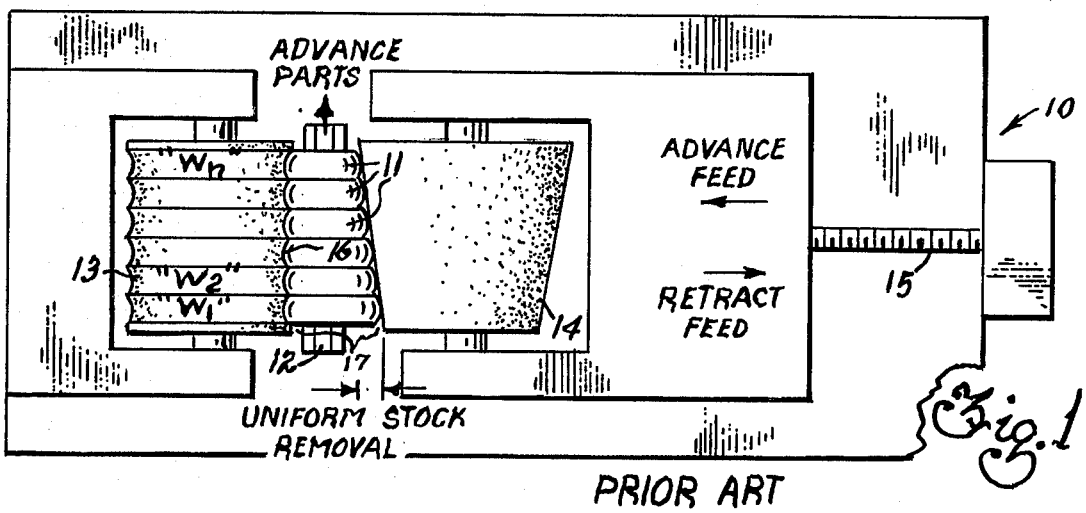
Fig. 1 PRIOR ART
FIG. 1 is a plan view of a prior art centerless grinder performing a constant stock removal rate infeed grind operation on a plurality of workpieces.

FIG. 1 depicts a prior art grinding machine 10 for grinding a plurality of workpieces 11 which are carried on a work support 12 between a grinding wheel 13 and a regulating wheel 14. Since the surfaces to be ground on the workpieces 11 are not always cylindrical, it is frequently necessary to grind them in an "infeed" grinding mode, i.e. the workpieces 11 remain axially stationary while being ground. The workpieces 11 are successively reduced in diameter from an entering, "rough", workpiece size to an exiting, "finish" workpiece size, and the regulating wheel 14 is therefore generally tapered along its length to maintain contact with the range of workpieces 11. Feed movement is accomplished by linearly moving the regulating wheel 14 radially with respect to the grinding wheel 13 along a feed screw 15, and, therefore removing stock at a constant rate from each workpiece 11, simultaneously. After a grind operation, the regulating wheel 14 is retracted and the workpiece stack is axially advanced by a feeding mechanism (not shown) to index the workpieces 11 to their next successive work stations "$W_1$", "$W_2$", . . . "$W_n$" defined along the face 16 of the grinding wheel 13, and a new rough workpiece 11 enters at the inlet end 17 between the wheels 13,14.

Figure 2:
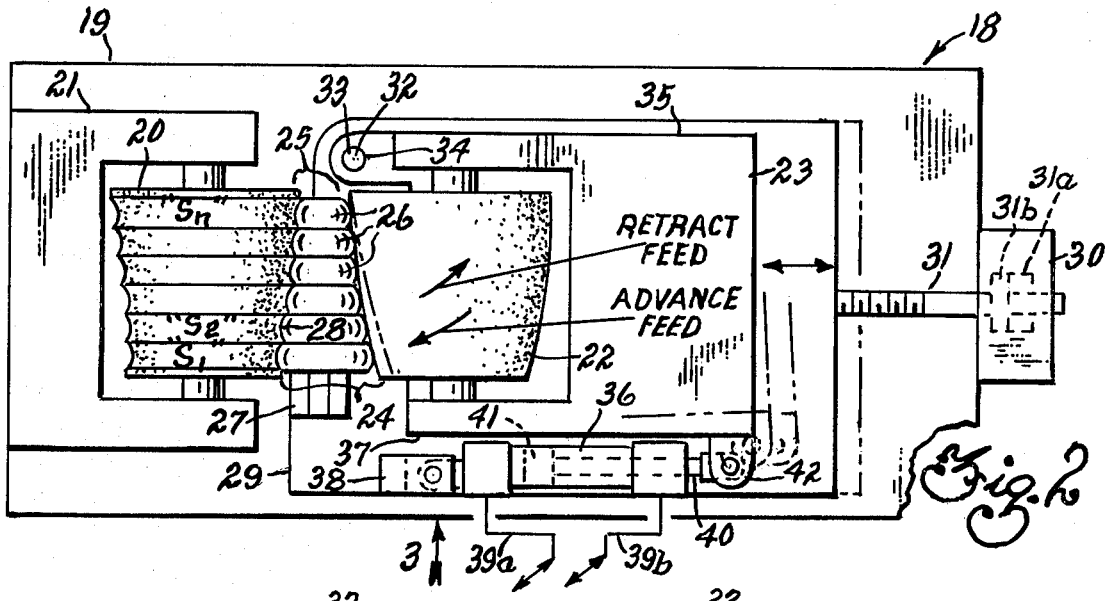
FIG. 2 is a plan view of centerless grinder performing variable stock removal rate infeed grind operations on a plurality of workpieces.

The plan view depicted in FIG. 2 illustrates a centerless grinding machine 18 of the present invention having a base 19, and grinding wheel 20 is rotatably carried in a grinding wheelhead 21 which in turn is affixed to the base 19. A regulating wheel 22 is rotatably journaled in a regulating wheelhead 23 and is movable relative to the grinding wheel 20, defining an inlet end 24 and an outlet end 25 between the wheels 20,22. A plurality of workpieces 26 are carried on a work support 27 between the wheels 20,22 in conventional manner, and the exemplary workpieces 26 depicted are spherical bearing races, stacked for infeed grinding. The plurality of workpieces 26 define a plurality of work stations "$S_1$", "$S_2$", . . . "$S_n$" along the face 28 of the grinding wheel 20 and the grinding wheel 20 is shaped to conform to the desired workpiece profile at the work stations "$S_1$", "$S_2$" . . . "$S_n$". The work support 27 is carried on a slide 29 which is radially movable in a linear fashion with respect to the grinding wheel 20 by means of an infeed unit 30 affixed to the base 19. A feed screw 31 is threadably engaged in the slide 29 to provide adjustment, and a piston 31*a* is operable in a cylinder 31*b* to retract the screw 31 and slide 29 to provide clearance between the workpieces 26 and the grinding wheel 20 when advancing the workpieces 26 to their subsequent work stations "$S_1$", "$S_2$" . . . $S_n$. The regulating wheel 22 is curvilinearly profiled along its length to conform to successively reduced workpiece sizes from the inlet end 24 to the outlet end 25 of the wheels 20,22. In the preferred embodiment, the grinding wheel 20 is shaped such that the workpieces 26 will be concentric, thus tending to minimize relative slip between the workpieces 26. It may be appreciated that the wheel 20 may be shaped in similar fashion as the prior art wheel 13, with commensurate slip between the workpieces 26.

The regulating wheelhead 23 is pivotable on the slide 29 about a pivot point 32 established by a pivot pin 33 relatively fixed in the slide 29 and having a slip fit in a cooperating bore 34 in the regulating wheelhead 23. The pivot point 32 is located proximate to the outlet end 25 of the wheels 20,22, i.e. at the rear 35 of the regulating wheelhead 23, while a fluid-operated cylinder 36 is clevis-mounted to the slide 29 proximate to the front 37 of the regulating wheelhead 23 by a bracket 38 and connected by fluid lines 39*a,b*, to a suitable fluid power source (not shown), and the external rod end 40 of the relatively movable piston 41 is clevis-mounted to the regulating wheelhead 23 by a bracket 42 affixed to the front 37. Thus, as the piston 41 is powered in the cylinder 36, the regulating wheelhead 23 will pivot from the solid position shown to the phantom position, and the reverse. Feed movement, therefore, is arcuate about the pivot point 32. Total movement is compounded of straight movement for clearance and arcuate movement for grinding. When the grind operation has been completed, the regulating wheel 22 is retracted and the workpieces 26 are advanced to their next subsequent stations, while a rough workpiece 26 enters the system by means of a workpiece axial indexing mechanism (not shown) and the next grind operation is ready to commence. Since the grinding wheel diameter may change due to wheel conditioning by a suitable wheel dressing means (not shown), the slide 29 and regulating wheelhead 23 are compensatingly advanced by the feed screw 31.

Figure 3:
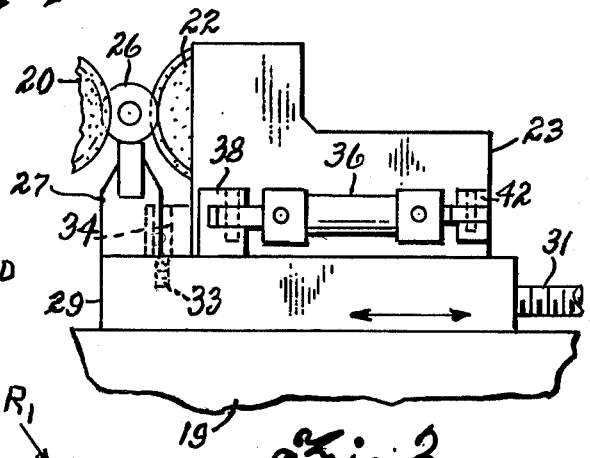
FIG. 3 is an elevational view of the centerless grinder taken in the direction of arrow 3 of FIG. 2.

FIG. 3 depicts the slide 29 on the base 19 where it may be linearly fed by the feed screw 31 or piston 31*a*, and the slide 29 carries the pivotable wheelhead 23 and the work support 27.

Figure 4:
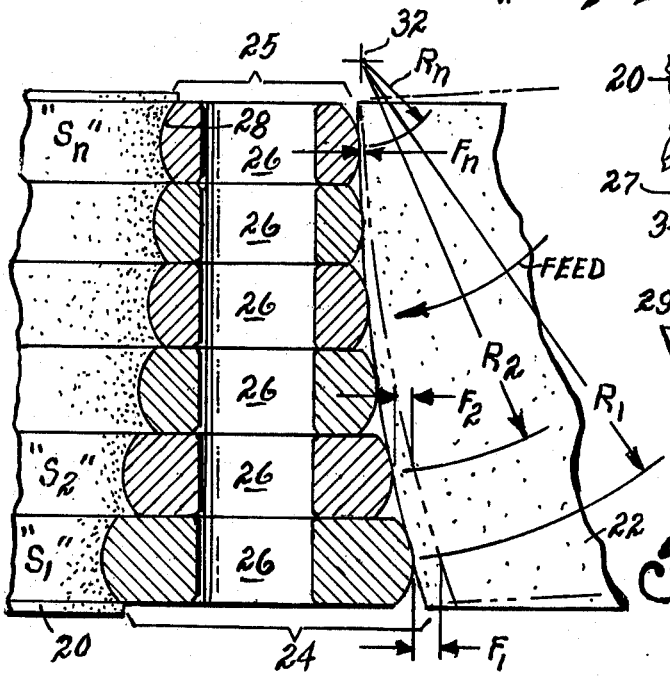
FIG. 4 is an enlarged plan view of the grinding zone of the centerless grinder of FIG. 2.

FIG. 4 is an enlarged view showing the grinding zone during a feed operation. Here is may be seen that the workpieces 26 vary in diameter from the inlet end 24 to the outlet end 25 between the wheels 20,22 and the grinding wheel 20 is shaped to conform to the desired workpiece profile at the plurality of work stations "$S_1$", "$S_2$" . . . "$S_n$", defined along its face 28. The regulating wheel 22 is profiled and curvilinearly tapered to maintain contact with the progressive work sizes, and, as the regulating wheel 22 is fed arcuately in the direction of the arrow, it will be seen that the amount of stock removal "$F_1$", "$F_2$", . . . "$F_n$" will be directly proportional to the radial distances from the pivot point 32 to the workpieces 26, "$R_1$", "$R_2$", . . . "$R_n$". All stock removal takes place during the same time interval, and in this fashion, therefore, a coarse grind rate is achieved at the inlet end 24 and a fine feed grind rate is obtained at the outlet end of the wheels 20,22 and proportional feed rates on all the workpieces 26 therebetween.

It is not intended that the invention be limited to the embodiments shown in the drawings, but rather that the invention also comprises all such designs and modifications as may come within the scope of the appended claims.

What is claimed is:

1. A centerless grinder, comprising in combination:

a. a base;

b. a grinding wheel, rotatably journaled in a grinding wheelhead on said base;

c. a regulating wheel rotatably journaled in a regulating wheelhead on said base and disposed relative to said grinding wheel so as to form an inlet end and an outlet end between said wheels;

d. a work support located between said wheels, and adapted to support a workpiece of revolution; and e. means for effectuating relative pivotal feed movement between said regulating wheel and said grinding wheel during the grinding process and varying the feed distances along the face of said regulating wheel relative to said grinding wheel.

2. The centerless grinder of claim 1, further comprising means to compensatingly move said wheels relative to one another after wheel conditioning.

3. The centerless grinder of claim 1, wherein the face of one of said wheels is conditioned to simultaneously contact a serially-related plurality of workpieces having successive work profile diameters.

4. The centerless grinder of claim 1 wherein said effectuating means is pivoted proximate to said outlet end and progessively increases the feed distances along the face of said regulating wheel relative to said grinding wheel from said outlet end to said inlet end.

5. A centerless grinder, comprising in combination:

a. a base;

b. a grinding wheel, rotatably journaled in a grinding wheelhead fixedly carried by said base;

c. a regulating wheel, rotatably journaled in a regulating wheelhead movably carried by said base with respect to said grinding wheelhead, and disposed relative to said grinding wheel so as to form an inlet end and an outlet end between said wheels;

d. a work support located between said wheels, and adapted to support a workpiece of revolution;

e. a plurality of serially related work stations defined along a face of said grinding wheel; and f. feed means for pivoting said regulating wheel about said outlet end during the grinding process and effectuating a plurality of variable speed distances and rates along the face of said regulating wheel corresponding to said work stations.

6. The centerless grinder of claim 5, wherein the face of said regulating wheel is conditioned to contact a serially-related plurality of workpieces having successively-reduced work profile diameters.

7. The centerless grinder of claim 5, further comprising means to incrementally advance a plurality of workpieces to said serially-related work stations.

8. A centerless grinder, comprising in combination:

a. a base;

b. a grinding wheel, rotatably journaled in a grinding wheelhead fixed on said base;

c. a regulating wheel, rotatably journaled in a regulating wheelhead movably carried by said base with respect to said grinding wheelhead, and disposed relative to said grinding wheelhead so as to form an inlet end and an outlet end between said wheels, wherein the face of said regulating wheel is conditioned to contact a serially-related plurality of workpieces having successively reduced the work profile diameters;

d. a work support located between said wheels, and adapted to support a workpiece of revolution;

e. a plurality of serially-related workstations defined along the base of said grinding wheel;

f. feed means for pivoting said regulating wheel about said outlet end during the grinding process and effectuating a plurality of variable feed distances and rates along the face of said regulating wheel corresponding to said work stations, said feed distances and rates progressively increasing from said outlet end to said inlet in;

g. means to incrementally advance a plurality of workpieces to said work stations; and h. means to compensatingly move said regulating wheel after wheel conditioning.

* * * * *